US005346607A

United States Patent [19]

Swanson et al.

[11] Patent Number: 5,346,607

[45] Date of Patent: Sep. 13, 1994

[54] ELECTROLYTIC TINPLATING AND PRODUCT

[75] Inventors: John L. Swanson, Pittsburgh, Pa.; Lowell W. Austin, Weirton, W. Va.

[73] Assignee: Weirton Steel Corporation, Weirton, W. Va.

[21] Appl. No.: 954,762

[22] Filed: Sep. 30, 1992

[51] Int. Cl.[5] ..... C25D 3/30; C25D 21/18; C25D 5/26

[52] U.S. Cl. ..... 205/99; 205/101; 205/140; 205/154; 205/301; 428/648

[58] Field of Search ..... 205/99, 101, 140, 154, 205/301; 428/648

[56] References Cited

U.S. PATENT DOCUMENTS

| | | | |
|---|---|---|---|
| 2,673,836 | 3/1954 | Yonada | 205/140 |
| 3,769,182 | 10/1973 | Beckwith et al. | 205/253 |
| 3,997,301 | 12/1976 | Yoshihara et al. | 428/648 X |
| 4,118,289 | 10/1978 | Hsu | 205/253 |
| 4,326,896 | 4/1982 | Lyu et al. | 428/648 |
| 4,508,480 | 4/1985 | Salm | 428/648 X |

FOREIGN PATENT DOCUMENTS

| | | | |
|---|---|---|---|
| 0015433 | 2/1979 | Japan | 205/140 |

*Primary Examiner*—Donald R. Valentine
*Attorney, Agent, or Firm*—Raymond N. Baker

[57] ABSTRACT

Stannous electrolytic tinplating baths utilized in flat-rolled steel tinplating operations contain non-filterable lead in solution at undesirable levels because of the lead content of commercially available tin anode materials. As taught herein, lead in the electrolyte is controllably incapacitated for deposition with the tin by chemical treatment of the bath which establishes, in solid phase, an insoluble bivalent metal compound having an affinity for lead which is adsorbed. In a preferred halogen-system embodiment, calcium fluoride presents an extended surface area for adhesion of lead and not only incapacitates lead in the bath for deposition purposes but also enables separation of such adsorbed lead from the plating bath as part of sludge removal. Quantitatively increasing, within an established range, the concentration of such a lead-absorbent solid-phase bivalent metal compound in the plating bath quantitatively decreases the percent by weight of lead deposited as part of the tin plating on the substrate.

12 Claims, 2 Drawing Sheets

ELECTROLYTIC TINPLATING AND PRODUCT

This invention is concerned with improving electrolytic tinplating of continuous-strip flat-rolled steel and, more particularly, with improvements in halogen-bath tin mill processing and product.

Electrolytic tinplating of flat-rolled steel for fabricating long-shelf-life rigid containers for comestibles has played and continues to play an important role in preserving and efficient distribution of foodstuffs. Decreasing lead exposure for such canned product became an important objective starting more than two decades ago when side-seam soldering of cans was substantially eliminated in canmaking procedures in the U.S.A.

And, for more than a decade tinplate producers and others have expended considerable effort to decrease the lead in tinplating by decreasing the lead content of the solidified sources of tin utilized in electrolytic tinplating. During halogen electrolytic processing the lead content in the anode deposits out on the steel substrate in about the same percentage by weight as that occurring in the tin anode. However, commercially available solid sources of tin for making electrolytically tinplated can stock generally have had and continue to have a lead content above objectives of the present invention.

A specific embodiment of this invention is directed to managing a halogen system electrolytic plating process for flat-rolled steel substrate and selectively decreasing the lead available for deposition from the plating bath.

Prior art background on stannous ion aqueous solution halogen system processing is set forth in *The Technology of Tinplate,* by W. E. Hoare, et al, published by St. Martin's Press, New York, N.Y. 10010, Copyright 1965, such descriptive background starting under the heading "Halogen Process" at page 239 and extending to but not including page 245 is incorporated herein by reference.

Metallurgically refined tin and tin reclamation services have provided commercially available solid sources of tin anode materials with lead content generally around 0.05 percent by weight. And, with additional endeavors such materials are starting to become available in which lead content can approach an average of about 0.02%. Also, attempts have been made to decrease lead content deposited from solution by operating at special current densities but such attempts have not and cannot be successful over an extended period of operation.

The present invention takes a differing approach by chemically decreasing lead available for deposition from an electrolytic plating bath solution and thereby decreasing the percent by weight of lead in the tin deposited on the steel substrate.

Figure 1:
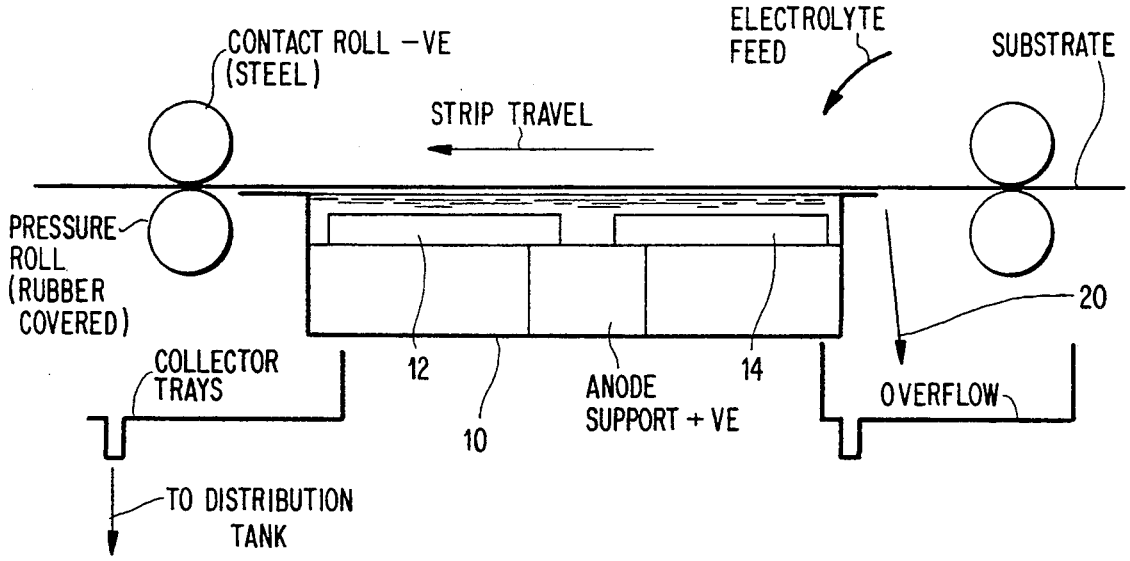
Figure 2:
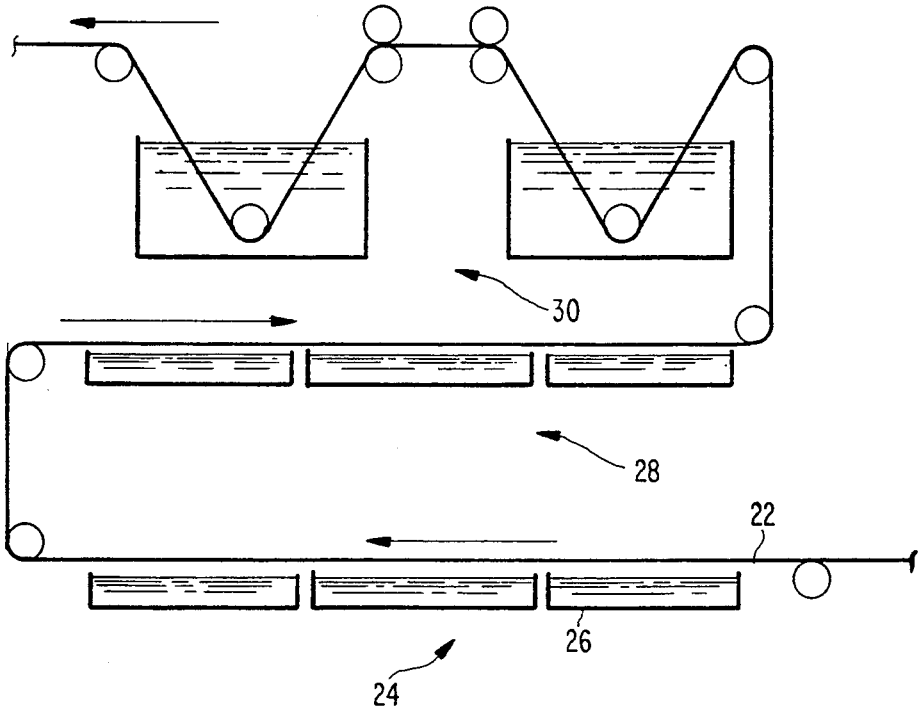
Figure 3:
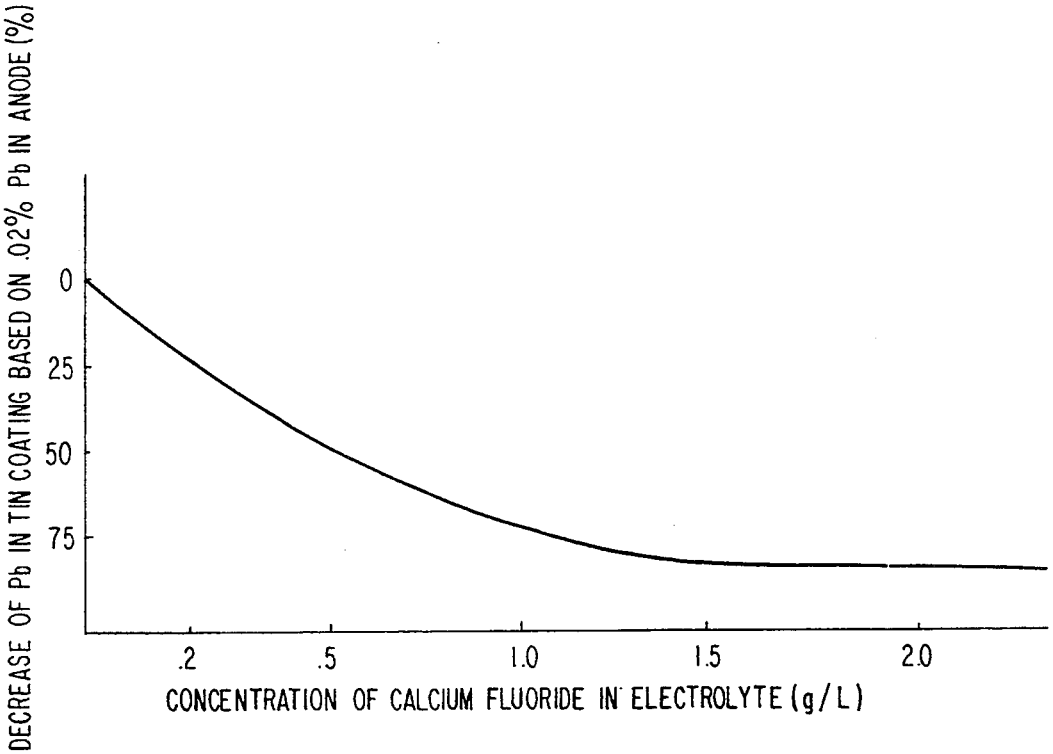

The above and other contributions of the invention are set forth in more detail in the accompanying description presented in conjunction with the accompanying drawings, in which FIG. 1 is a cross-sectional schematic view of a halogen system plating cell;

FIG. 2 is a schematic general arrangement of a halogen-system continuous-strip plating line, and FIG. 3 is a graphical presentation of chemical treatment data.

Referring to FIG. 1, a tinplating cell 10, which is electrically insulated on its interior surface, supports solidified sources of tin such as bars 12 and 14. A series of such bars extending across the width of the strip comprise the anode. The tin anode is connected for electrolytic dissolution during plating of one surface (at a time) of flat-rolled steel substrate which is electrically connected as the cathode in the system. Such bars are replaced as dissolved to maintain uniform spacing between the anode and the surface to be plated.

In continuous-strip processing the electrolytic solution is fed from a distribution tank means (not shown) into a plurality of cells in the line. A more-or-less continuous overflow of electrolyte from each cell takes place where indicated (20 in FIG. 1) and cell overflow is returned through collector trays to the electrolyte distribution means.

Referring to the continuous-strip line of FIG. 2, strip 22 is coated on one surface at a time as it is fed horizontally at the surface of the bath through a first series 24 of individual plating cells, such as 26. In a second series 28 of plating cells, in a next overhead return passage of the line, the strip is coated on the remaining surface and then, in a third tier 30 (with the strip traveling in the original direction) drag-out plating solution is reclaimed and the plated strip is washed.

An operational objective of the present invention is to decrease lead available for deposition from the bath without disturbing the plating efficiency of the line and without disturbing the excellent appearance and uniformity of the tin coating achievable through usage of the tinplating line, in particular the halogen-bath type.

Another objective of a halogen line would be to maintain the fluoride ion level to sustain desired concentrations of fluorostannite complex ion $(SnF_6)^{-4}$ so as to prevent undesired precipitation (in the bath), of the tin salts relied on for plating tin. Also, while a general range for the pH value is about 2 to less than about 5, maintaining a preselected pH range for the bath of about 3 to 4 is taught herein with a preferred pH level being approximately 3.5. Other objectives are to maintain the stannous tin, chloride, and fluoride concentrations at the desired levels without increasing stannic ion concentration. In general, an operational bath temperature of about 65° C. would not be significantly disturbed nor would the current densities normally used (about 100 to 600 amps per square foot of surface to be plated) be disturbed.

It is significant that, as taught herein, these objectives are attained chemically by adding ingredients which are chemically compatible with the bath.

The lead content of an electrolytic plating bath results from the electrolytic dissolution of tin anodes; and, in prior practice, the lead content of the anode was deposited (during sustained plating of any significant time period) at about the same rate as it was electrolytically introduced into the bath.

The mechanism of the present invention rather than concentrating on decreasing the lead going into solution concentrates on decreasing the lead available (from the bath) for electrolytic deposition purposes.

If lead content of about 0.02 percent by weight in the solid tin anodes could be consistently obtained, it would by prior practice, deposit 0.02 percent by weight lead as part of the tinplating, which could result in an undesirable lead content in certain container liquids.

However, the present invention decreases the lead capable of being deposited from baths formed from commercial sources of tin so as to enable decreasing the percentage, by weight, of lead in the tin deposited on the flat-rolled steel.

Chemical treatment of the plating bath solution has not previously been advanced as a means for predeterminedly controlling the amount of lead which can be deposited from a halogen-system electrolytic tinplating bath. Enabling dependable long-range quantitative control of lead which can be deposited from a halogen electrolytic tinplating bath and, further, enabling dependable removal of contaminant lead from the tinplating bath without detrimental loss of stannous ions, nor significant detriment to the desired concentrations of other halogen line tinplating bath constituents, are significant contributions taught herein.

A specific embodiment teaches controllably decreasing the lead capable of being tin deposited from a plating bath formed from a tin anode having above a percentage by weight of lead (e.g. above 0.015%) such that the percentage by weight of lead deposited is less than that formed electrolytically in the bath (e.g., less than about 0.015% by weight).

A significant part of the chemical treatment taught is the establishment, in solid phase, of a special bivalent metal compound in the plating bath which by adsorption of lead controllably incapacitates electrolytic deposition of lead from the bath.

In a specific embodiment of a halogen system, the invention designates bivalent metal compounds which are insoluble in the plating bath within a prescribed range of pH levels for operations (about 2 to about 5), which can be introduced without detriment to the plating itself or significant detriment to the plating bath, and which under such circumstances exhibits desired surface area and lead adsorption properties. Bivalent strontium or radon are preemptively precluded by teachings of the present invention because of the negative aspects for environmental purposes associated with those two bivalent metals. Also, economically impractical bivalent metals such as beryllium or barium are excluded; as are radicals of any bivalent metal salts which are not compatible with constituents of the bath for plating purposes.

A specific halogen-system embodiment is illustrated in FIG. 3 by graphically showing the relationship between calcium fluoride concentration in the halogen electrolytic bath and the decrease in percentage of lead deposited with the tin on the substrate. In such chemical treatment, quantitatively controlling (by increasing) the concentration of calcium fluoride provides for quantitatively controlling (by decreasing) the percentage of lead in the tin deposited from the bath. The tinplating data in FIG. 3 were obtained at 150 amperes per square foot (ASF). The percentage decrease in lead (by weight) in the tin deposited is represented in percentage (of that available from the anode) along the "Y" axis, and the concentration of calcium fluoride, in grams per liter, in the halogen tinplating bath is indicated along the "X" axis.

In a preferred method, calcium chloride (which can be readily added to the halogen-system bath without detriment because of the presence of other chlorides) is added to form calcium fluoride in situ. The calcium fluoride (1) has non-crystalline (substantially gelatinous) characteristics in the halogen fluoride plating bath as set forth herein, (2) is substantially insoluble at the preselected pH levels, and (3) has an affinity for lead which substantially enhances the association of the lead in solution with the insoluble fluoride so as to incapacitate the lead for deposition. In addition, such adsorption of lead by the calcium fluoride enables separation from the plating system by centrifuge or periodic removal of accumulated sludge.

In other words, the lead associates with the calcium fluoride by surface adhesion so as to prevent electrolytic deposition and so as to enable physical separation with the sludge from the remaining plating bath liquid. Addition of magnesium chloride also results in formation of insoluble magnesium fluoride which adsorbs lead. In general, calcium chloride is also preferred because of its economy in relationship to magnesium chloride.

In the plating cell arrangement shown in a continuous-strip tinplating line, a distribution tank (not shown) circulates electrolyte at a high rate (for example, about 60 to 70 gallons per minute per cell in a twenty-eight cell system having a total capacity of about 25,000 gallons).

A relatively uniform decrease in lead available for deposition in a halogen system can be readily obtained by adding an insoluble calcium compound such as calcium fluoride or calcium silicate which presents an extended surface area exhibiting an affinity for adsorption of lead. While a soluble calcium compound such as calcium chloride can be added to form, in situ, calcium fluoride, other soluble calcium compounds will form insoluble calcium fluoride at prescribed pH levels. For example, calcium hydroxide would form insoluble calcium fluoride but would acquire pH regulation. A compound such as calcium bromide would also form calcium fluoride but the build-up of bromide in the halogen system would be detrimental and eventually unacceptable.

Calcium fluoride can be added directly, without going through the conversion of calcium chloride to calcium fluoride in situ; however, formation of calcium fluoride in situ can exhibit a more effective capability for adsorbing lead.

In practicing the preferred specific embodiment, it is first important to establish the desired calcium fluoride concentration in the plating system and then to maintain the desired concentration by introducing or establishing the calcium fluoride at a rate commensurate with the rate that the lead is being electrolytically introduced into the solution. For the latter purpose, calcium chloride or calcium fluoride can be added contiguous to the location for dissolution of the anode in the plating cell. For example as part of the present invention, calcium chloride or calcium fluoride can be embodied in the solidified tin anode so as to enter solution for its purpose at a rate commensurate with the rate that the contaminant lead is being introduced with electrolytic dissolution of the tin anode.

The chemical treatment results in the lead in solution taking on characteristics, for electrolytic deposition purposes, of a solid; as represented by the following:

$$Pb_{(solid)} \rightarrow Pb^{++} \rightarrow \underset{(non\text{-}soluble)}{CaF_2 + Pb}$$

The calcium fluoride exhibits a non-crystalline character with a surface area which because of gelatinous properties can be substantially unlimited in the described plating solution. Such insoluble calcium fluoride exhibits an affinity for ionic adsorption of lead which incapacitates the adsorbed lead for deposition; and, in addition, that the lead adheres to the calcium fluoride so as to enable removal of the lead during removal of sludge from the system.

Another contribution to be noted is that calcium fluoride produced by reacting calcium chloride, in situ, forms a highly-active insoluble calcium fluoride, with gelatinous characteristics for adsorption of lead while releasing chloride to produce hydrochloric acid and/or also sodium chloride. Such byproducts are useful in the halogen tinplating bath so that the removal of lead can be carried out without significantly disturbing bath constituents and/or desired pH levels.

While specific examples of the relationships of constituents have been set forth for purposes of describing the invention, other examples are available to those skilled in the art in light of the above teachings; therefore, it is to be understood that the scope of the invention is to be determined by considering the scope of the appended claims.

We claim:

1. Halogen-system electrolytic tinplating of flat-rolled steel, comprising the steps of (A) providing electrolytic plating cell means with an aqueous stannous electrolytic plating bath and means for connecting flat-rolled steel substrate to serve as the cathode for electrolytic tinplating during passage through such bath, in which the pH of the electrolytic plating bath is in a range of about 2 to less than about 5 and such plating bath contains an alkali metal fluoride in solution, such plating bath including sufficient fluoride ion to sustain fluorostannite complex ion $(SnF_6)^{-4}$ concentration so as to prevent undesirable precipitation of stannous ion salts from the bath within such pH range, with stannous ions entering the electrolytic bath solution from solid sources of lead-contaminated tin electrolytically connected to serve as the anode for electrolytic tinplating, such anode including lead so as to electrolytically introduce normally unfilterable lead into the solution at or above a level which would result in an undesirable percentage of lead in the tin as electroplated from the bath onto the flat-rolled steel substrate, and (B) chemically treating the electrolytic plating bath to establish a solid-phase bivalent metal compound in such plating bath, the solid-phase of such bivalent metal compound being substantially insoluble in such plating bath within such pH range of operations, such solid-phase bivalent metal compound exhibiting an extended surface area having an affinity for adsorption of such previously unfilterable electrolytically-introduced lead which associates itself with the solid-phase bivalent metal compound within such pH range of operations so as to prevent its deposition from the bath onto the flat-rolled steel, thus decreasing the percentage by weight of lead in the tin electrolytically deposited to a percentage by weight below the percentage by weight of lead being introduced to such bath from such tin anode.

2. The process of claim 1 further including the steps of providing the flat-rolled steel as continuous-strip, and (C) physically separating such substantially insoluble solid-phase bivalent metal compound and associated lead from such plating bath within such pH range of operations, and in which steps (B) and (C) are carried out while maintaining desired fluoride and chloride concentrations during continuous-strip flat-rolled steel substrate electrolytic tinplating operations.

3. The invention of claim 2, in which the tin anode has a lead content above a percentage by weight desired in the tinplating deposited on flat-rolled steel to be used for canning comestibles, and in which such solid-phase bivalent metal compound is selected from the group consisting of calcium fluoride and calcium silicate.

4. The process of claim 3 in which the substantially insoluble bivalent metal compound comprises calcium fluoride, and such chemical treatment comprises adding calcium chloride to the electrolytic tinplating bath to form calcium fluoride in situ.

5. The process of claim 4, including initially establishing a calcium fluoride concentration in such electrolytic plating bath within a range of above about 0.2 grams to about 2 grams of calcium fluoride per liter of bath solution, and then controllably maintaining calcium fluoride within such concentration range.

6. The process of claim 2 in which such chemical treatment to establish a substantially insoluble bivalent metal compound includes adding calcium chloride to the plating bath to form calcium fluoride in situ, and in which the percentage of lead incapacitated for deposition from the plating bath due to adhesion on such calcium fluoride is controlled quantitatively by quantitatively controlling addition of calcium chloride to the plating bath.

7. The process of claim 6, in which the pH of the electrolytic plating solution is in the range of about 3 to about 4, and the calcium fluoride is established in the electrolytic plating bath solution for a plurality of plating cells by selecting from the group consisting of (a) adding calcium fluoride as part of general distribution of such electrolytic solution to such plating cells, (b) adding calcium fluoride from the tin anode in a cell during electrolytic dissolution of such tin anode, (c) adding calcium chloride as part of general distribution of such electrolytic solution to such plating cells, (d) adding calcium chloride from the tin anode in a cell during electrolytic dissolution of such tin anode, and (e) combinations thereof.

8. Process for treating a halogen system electrolytic bath in use for tinplating continuous-strip flat-rolled steel substrate so as to decrease lead available for deposition, comprising the steps of (A) providing an aqueous electrolytic tinplating bath having stannous ions in solution electrolytically introduced from solid sources of tin having an impurity content which includes above about .015% by weight of lead such that lead is electrolytically entering solution and being deposited above a desired percentage by weight in the tinplating deposited on such steel, such aqueous bath comprising an alkali metal fluoride solution with sufficient fluoride ion concentration to sustain fluorostannite complex ion in solution $(SnF_6)^{-4}$ at a level to prevent undesirable precipitation of stannous ion salts from the bath during operations with a pH of such bath in the range of about 3 to about 4, and (B) providing solid-phase calcium fluoride in such bath in a concentration to adsorb and incapacitate sufficient lead for deposition on the flat-rolled steel being plated to produce a tinplate on such flat-rolled steel substrate which is less than about 0.015% by weight, and (C) physically separating such solid-phase calcium fluoride and associated lead from such electrolytic bath during such tinplating operations.

9. The process of claim 8, in which chemical treatment of the electrolytic tinplating bath to establish such solid-phase calcium fluoride includes adding calcium chloride to such bath, and establishing and maintaining calcium fluoride concentration in the range of about 0.2 to about 2 g/l of such bath and pH of such bath in such range of about 3 to about 4.

10. Stannous electrolytic tinplating solution formed by electrolytic dissolution of anode tin having a lead content above about 0.015% by weight in which the lead available for deposition from the tinplating solution has been decreased by chemical treatment to electrolytically deposit tinplate having a lead content of less than about 0.015% by weight.

11. Electrolytically tinplated flat-rolled steel, in which the lead content of the tin deposited electrolytically is less than about 0.015% by weight after plating in a halogen electrolytic process tinplating solution in which stannous ions are electrolytically introduced from a tin anode having a lead content above such percentage by weight of the deposited tin.

12. Continuous-strip process for producing the product of claim 11, in which an insoluble bivalent metal salt which adsorbs lead is selectively established in such electrolytic tinplating solution at a concentration to prevent electrolytic deposition of a selected percentage by weight of the lead electrolytically introduced into such plating solution from such tin anode.

* * * * *